US008540290B2

(12) United States Patent
Chen

(10) Patent No.: US 8,540,290 B2
(45) Date of Patent: Sep. 24, 2013

(54) STRUCTURE FOR ELECTRICAL LOCK

(76) Inventor: Te-Yu Chen, Pingtung (TW)

( * ) Notice: Subject to any disclaimer, the term of this patent is extended or adjusted under 35 U.S.C. 154(b) by 316 days.

(21) Appl. No.: 13/116,016

(22) Filed: May 26, 2011

(65) Prior Publication Data

US 2012/0299315 A1 Nov. 29, 2012

(51) Int. Cl.
*E05C 1/16* (2006.01)

(52) U.S. Cl.
USPC ..... 292/144; 292/167; 292/34; 70/107

(58) Field of Classification Search
USPC ..... 292/144, 167, 169.14–17, 33–37; 70/107, 149, 188, 189, 218, 222, 223, 277, 70/278.7, 283, 422, 475
See application file for complete search history.

(56) References Cited

U.S. PATENT DOCUMENTS 3,361,462 A * 1/1968 Foster ..... 292/165
4,583,382 A * 4/1986 Hull ..... 70/107
5,228,730 A * 7/1993 Gokcebay et al. ..... 292/144
5,876,073 A * 3/1999 Geringer et al. ..... 292/144
7,246,827 B2 * 7/2007 Geringer et al. ..... 292/144
8,162,358 B2 * 4/2012 Lin ..... 292/167

* cited by examiner

*Primary Examiner* — Kristina Fulton
(74) *Attorney, Agent, or Firm* — Leong C. Lei

(57) ABSTRACT

A structure for electrical locks comprises two rotational members, a latching assembly, and a controlling means. The two rotational members are respectively secured to two handles of a door. The latching assembly includes a cartridge, a sliding element, and a dividing rod. The dividing rod is fitted in the cartridge to define two lateral zones respectively corresponding to two recesses of the rotational members. The sliding member is slidably fitted in one of the lateral zones of the cartridge. The controlling means includes a pushing assembly and a solenoid. When the solenoid is de-energized, the pushing assembly can be moved forward to lock a respective handle. When the solenoid is energized, the pushing assembly can be moved back to free the respective handle. The structure can be easily applied in a door where one handle can be freely operated while the other handle can be electro-selectively operated.

5 Claims, 5 Drawing Sheets

STRUCTURE FOR ELECTRICAL LOCK

TECHNICAL FIELD OF THE INVENTION

The present invention relates to a structure for electrical locks and, more particular to, a structure for electrical locks that can be applied in a door where one of two handles can be selectively operated via energizing a solenoid.

DESCRIPTION OF THE PRIOR ART

Although digital locks, such as card locks or code locks, have advantages of exempting from carrying keys over conventional locks, they are more complicated in structure. In particular, it is not easy for the digital locks to be adapted for the existing locks or modified for a door in which one handle can be freely operated while the other handle can be selectively operated. Thus, for applying a digital lock, the existing lock should be dismantled and cannot be used again, thereby adding additional cost.

In view the foregoing, based on the long-term experiences of the lock devices and after constant efforts on the development and innovation of the related products, the applicant has contrived an improved structure for electrical locks that can be easily applied in conventional locks and applicable to a door where the handles can be selectively operated.

SUMMARY OF THE INVENTION

The primary object of the present invention is to provide a structure for electrical locks that can be applied in a door where one handle can be freely operated while the other handle can be selectively operated via energizing a solenoid.

The structure for electrical locks comprises two rotational members, a latching assembly, and a controlling means. The two rotational members are respectively secured to two handles respectively at two sides of a door, each rotational member adapted to be mechanically connected with a bolt for locking or unlocking the door, each rotational member defining a recess on a periphery thereof. The latching assembly includes a cartridge, a sliding element, and a resiliently dividing rod. The cartridge defines a first through passage and a second through passage substantially perpendicular to the first through passage. The sliding element has a first end and a second end, opposite to the first end, and defines a recess on a periphery between the first end and the second end. The recess of the sliding element extends in a direction substantially parallel to the second through passage of the cartridge. The resiliently dividing rod is fitted in the second through passage of the cartridge to divide the first through passage into two lateral zones respectively corresponding to the recesses of the rotational members. The sliding member is slidably fitted in one of the lateral zones of the first through passage capable of engaging with one of the recesses of the rotational members at the first end, wherein the second end of the sliding element is formed as a curved peripheral surface. The controlling means includes a resiliently pushing assembly and a solenoid for driving the resiliently pushing assembly to move back to a retracted position, the resiliently pushing assembly having an arm extending generally parallel to its moving direction, the arm being capable of engaging with the second end of the sliding element of the latching assembly such that, when said solenoid is de-energized, the resiliently pushing assembly can be normally moved forward to a latching position to have the first end of the sliding element moved out of the first through passage of the cartridge to be engaged with one of the recesses of the rotational members so as to lock a respective handle for protecting the door from being unlocked by the respective handle; when the solenoid is energized, the resiliently pushing assembly can be moved back by the solenoid to the retracted position so that the first end of the sliding element can move into the first through passage of the cartridge so as to free the respective handle to allow the door to be unlocked by the respective handle. In such arrangement, the sliding element can be selectively fitted in one of the lateral zones of the first through passage to allow the sliding member to engage with one of the recesses of the rotational members so as to selectively lock a respective handle to protect the door from being unlocked by the respective handle.

In the aforementioned structure, the sliding element can be moved from one lateral zone to the other lateral zone of the first through passage by fitting the resiliently dividing rod into the recess of the sliding element and then pushing the sliding element toward the other lateral zone via using a tool through a hole of the cartridge.

Other objects, advantages, and novel features of the present invention will become more apparent from the following detailed description when taken in conjunction with the accompanying drawings.

DETAILED DESCRIPTION OF THE PREFERRED EMBODIMENTS

Figure 1:
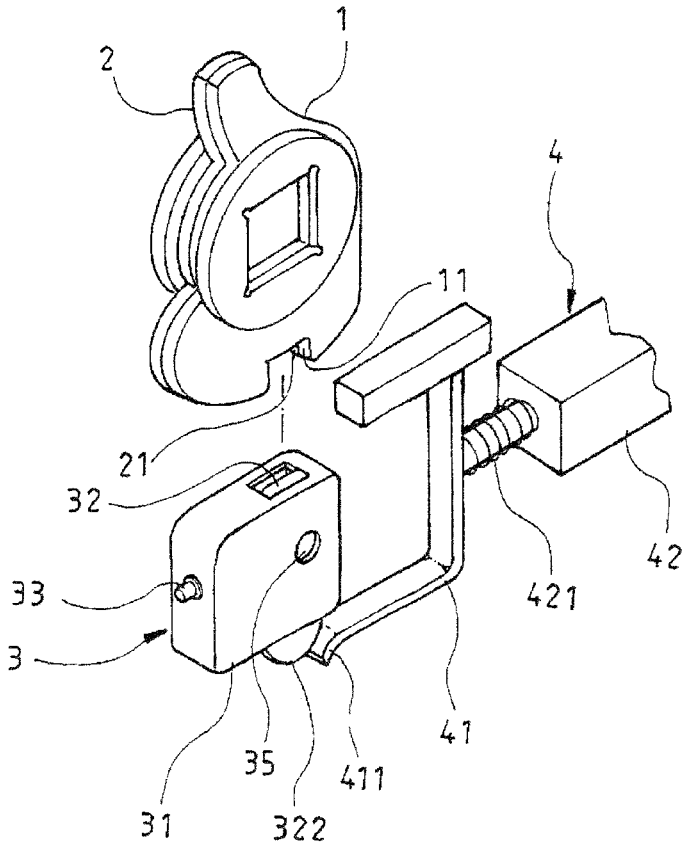
FIG. 1 is a 3-dimensional view of the present invention.
Figure 2:
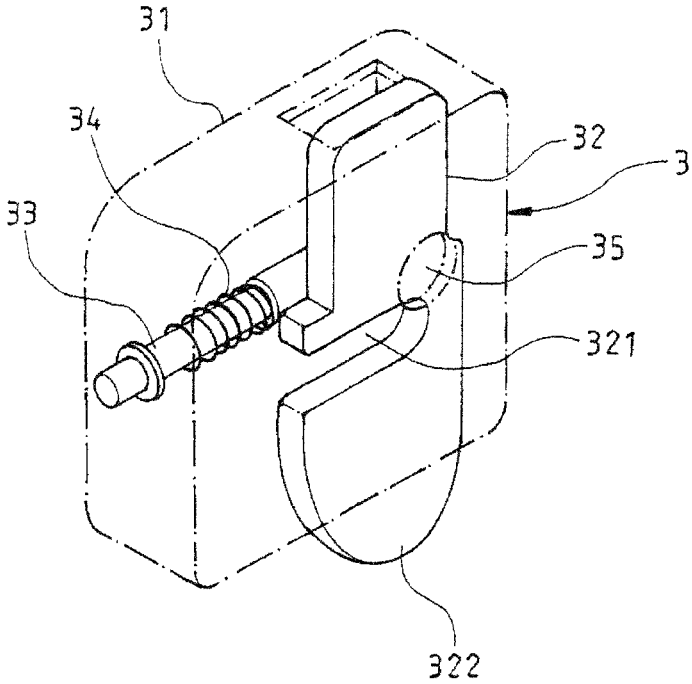
FIG. 2 is a 3-dimensional view showing a latching assembly of the present invention.
Figure 3:
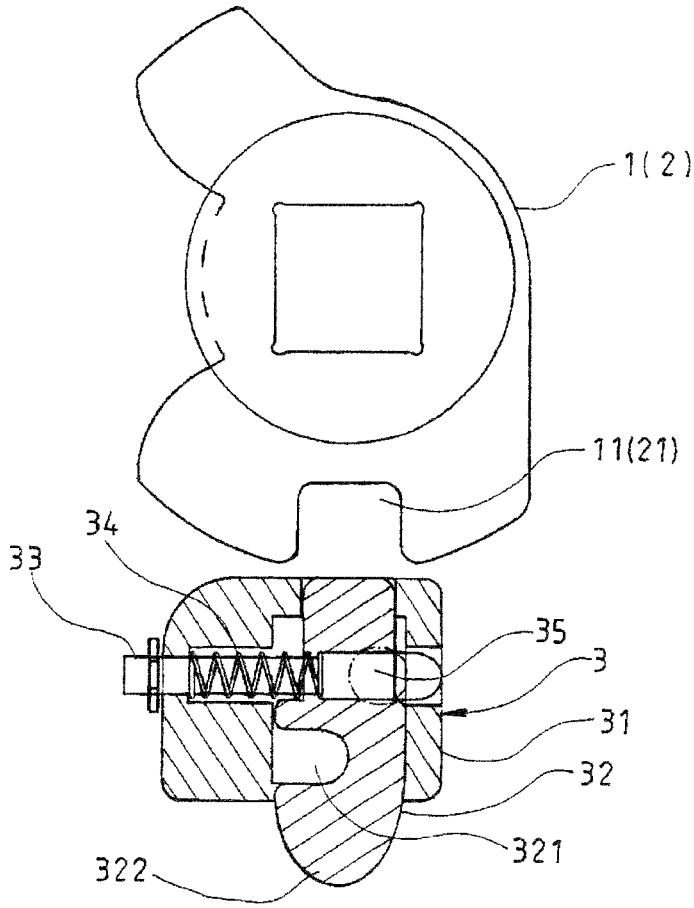
FIG. 3 is a sectional view showing the latching assembly of the present invention.

Referring to FIGS. 1, 2 and 3, a structure for electrical locks according to the present invention is shown, which generally comprises two rotational members 1, 2, a latching assembly 3, and a controlling means 4. The two rotational members 1, 2 are secured to two handles respectively at two sides of a door (not shown), each rotational member being connected to a bolt 5 (see FIG. 4) via a mechanical linkage for locking or unlocking the door, each rotational member defining a recess 11 or 21 on a periphery thereof. The latching assembly 3 includes a cartridge 31, a sliding element 32, and a resiliently dividing rod 33. The cartridge 31 defines a first through passage (or a vertical passage) and a second through passage (or a horizontal passage) substantially perpendicular to the first through passage. The sliding element 32 has a first end (or a top end) and a second end (or a bottom end), opposite to the first end, and defines a recess 321 on a periphery between the first end and the second end. The recess 321 of the sliding element 32 extends in a direction substantially parallel to the second through passage of the cartridge 31. The resiliently dividing rod 33 is fitted in the second through passage of the cartridge 31 to divide the first through passage into two lateral zones respectively corresponding to the recesses 11, 21 of the rotational members 1, 2. Furthermore, the resiliently dividing rod 33 is provided with a stopping collar at an outward end thereof and a compression spring 34 around a portion thereof within the second through passage of the cartridge 31 to provide a normally resilient force toward the second through passage. The sliding member 32 is slidably fitted in one of the lateral zones of the first through passage of the cartridge 31 capable of engaging with one of the recesses 11, 12 of the rotational members 1, 2 at the first end, wherein the second end of the sliding element 32 is formed as a curved peripheral surface.

As shown, the controlling means 4 includes a resiliently pushing assembly 41 and a solenoid 42 for driving the resiliently pushing assembly 41 to move back to a retracted position. The resiliently pushing assembly 41 has an arm extending generally parallel to its moving direction, the arm being capable of engaging with the second end of the sliding element 32 of the latching assembly 3 such that, when the solenoid 42 is de-energized, the resiliently pushing assembly 41 can be normally moved forward, by a compression spring 421 fitted around a shaft of the assembly 41 between the arm and the solenoid 42, to a latching position, at which the door is fasten by the bolt 5 (see FIG. 4), to have the first end of the sliding element 32 moved out of the first through passage of the cartridge 31 to be engaged with one of said recesses 11, 12 of the rotational members 1, 2 so as to lock a respective handle secured thereto for protecting the door from being unlocked by the respective handle. When the solenoid 42 is energized, the resiliently pushing assembly 41 can be moved back by the solenoid 42 to the retracted position so that the first end of the sliding element 32 can move into the first through passage of the cartridge 31 so as to free the respective handle to enable the respective handle secured thereto to rotate to unlock the door by the respective handle. Preferably, the arm have a front end 411 extends in a curved direction capable of mating with the second end of the sliding member 32 to facilitate a movement of the sliding element 32 along the first through passage of the cartridge 31.

In such arrangement, the sliding element 32 can be selectively fitted in one of the two lateral zones of the first through passages in the cartridge 31 to allow the sliding member 32 to engage one of the recesses 11, 12 of the rotational members 1, 2 so as to selectively lock the respective handle connected thereto so that the door cannot be unlocked by the respective handle.

Figure 4:
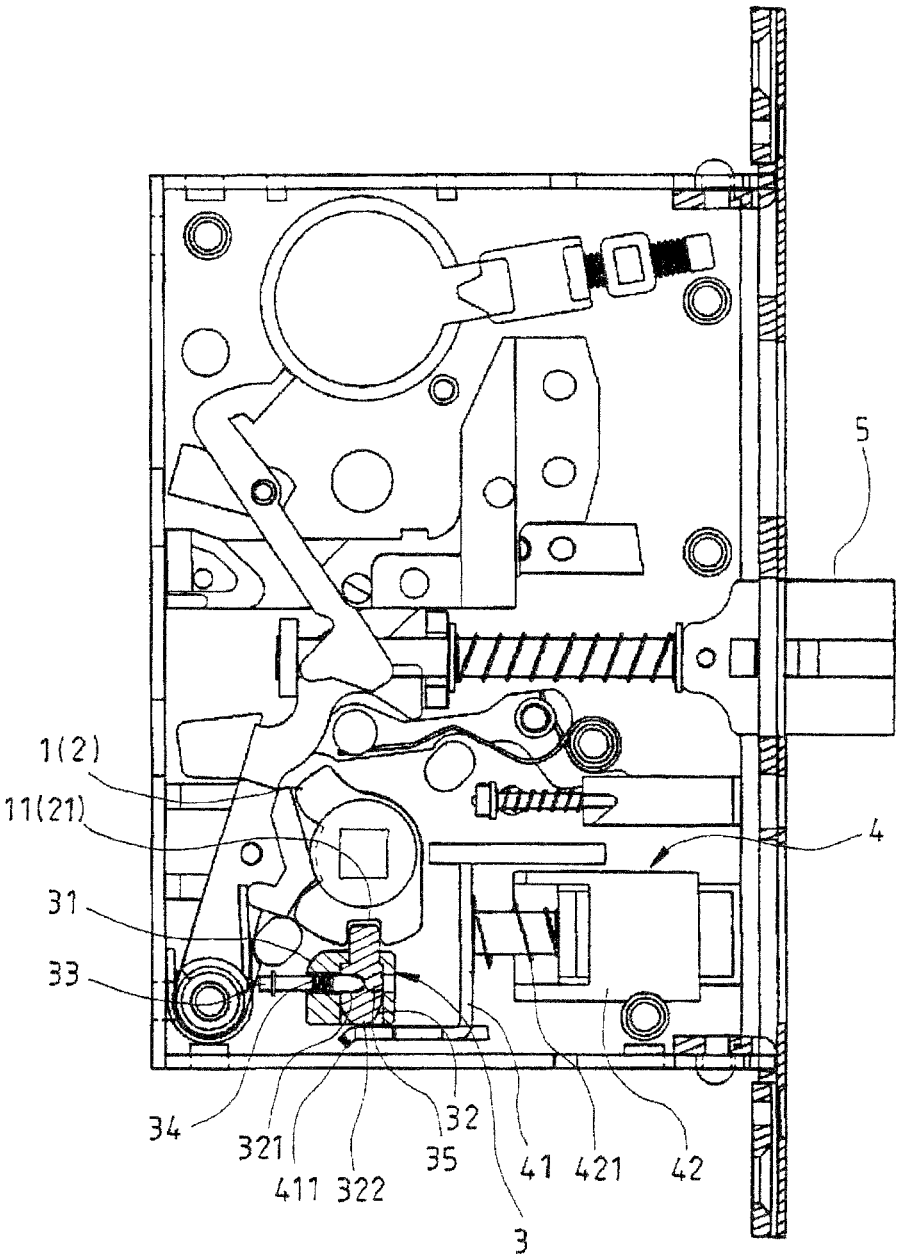
FIG. 4 is a plan view showing an operating condition of the present application in which the latching assembly is in normal state.

FIG. 4 shows an operating condition of the present invention applied in a door. In operation, as shown, when the solenoid 42 is de-energized, the resiliently pushing assembly 41 can be normally moved forward, by the compression spring 421 fitted around a shaft of the assembly 41 between the arm and the solenoid 42, to a latching position, at which the door is fastened by the bolt 5, whereby the arm of the resiliently pushing assembly 41 can slidably engage with the second end of the sliding element 32 so that the sliding element 32 can be moved upward along the first through passage of the cartridge 31 to have the first end of the sliding element 32 moved out of the first through passage of the cartridge 31 to engage with one of the recesses 11, 12 of the rotational members 1, 2 so that a respective handle secured thereto can be locked and thus the bolt 5 cannot be moved inward of the lock by the respective handle so that the door will remain a closed state.

Figure 5:
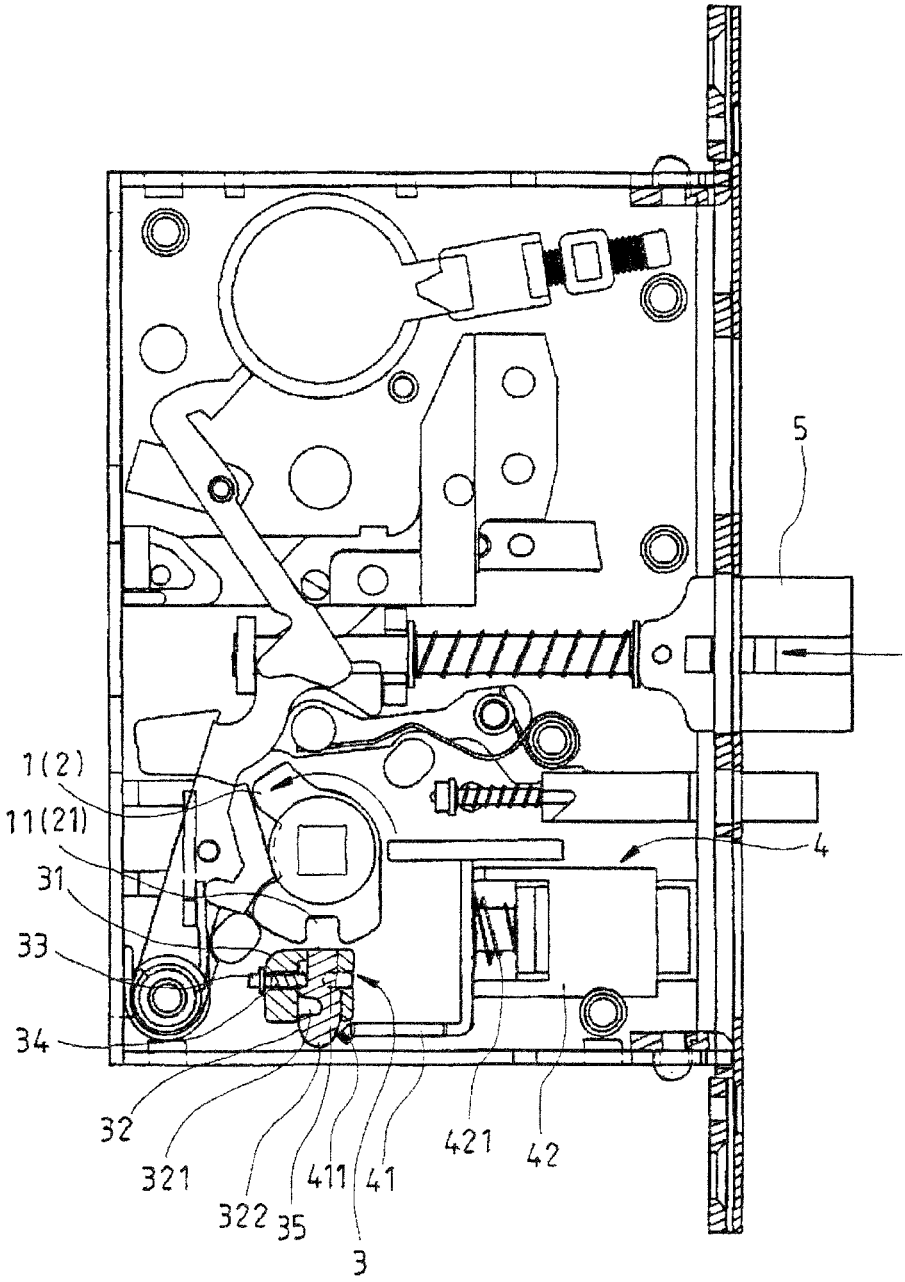
FIG. 5 is a plan view showing another operating condition of the present application in which the latching assembly is in actuated state (the solenoid being energized).

FIG. 5 shows another operating condition of the present invention applied in a door. In operation, as shown, when the solenoid 42 is energized (the energizing can be controlled via the electronic signal as used in card locks or code locks or the like), the resiliently pushing assembly 41 can be moved back by the solenoid 42 to a retracted position so that the first end of the sliding element 32 can move into the first through passage of the cartridge 31 so that the respective handle can be freely rotated to move the bolt 5 inward of the lock so as to unlock the door.

Referring again to FIG. 2, the sliding element 32 can be laterally moved from one lateral zone to the other lateral zone of the first through passage of the cartridge 31 to change an originally lockable handle to a free handle and to change an originally free handle to a lockable handle. To accomplish the purpose, the resiliently dividing rod 33 may be fitted into the recess 321 of the sliding element 32. Then, using a tool through a hole 35 of the cartridge 31 to push the sliding element 32 toward the other lateral zone, the sliding element 32 can be moved to the other lateral zone of the first through passage of the cartridge 31 so that the operating states of the two handles can be exchanged.

In view of the foregoing, the present invention provides a structure for electrical locks, which employs a latching assembly in cooperation with a controlling means, whereby an electrical lock can be applied in a door where one of handles can be freely operated while the other of handles can be selectively operated via energizing a solenoid of the controlling means. It is believed that the present invention is a useful design with novel features.

Although the present invention has been described with a certain degree of particularity, it is understood that the present disclosure is made by way of example only and the combination and arrangement of parts may be resorted to without departing from the spirit and scope of the invention hereinafter claimed.

I claim:

1. A structure for electrical locks comprising:

two rotational members respectively secured to two handles respectively at two sides of a door, each rotational member adapted to be mechanically connected with a bolt for locking or unlocking the door, each rotational member defining a recess on a periphery thereof;

a latching assembly including a cartridge, a sliding element, and a resiliently dividing rod, said cartridge defining a first through passage and a second through passage substantially perpendicular to said first through passage, said sliding element having a first end and a second end, opposite to said first end, and defining a recess on a periphery between said first end and said second end, said recess of said sliding element extending in a direction substantially parallel to said second through passage of said cartridge, said resiliently dividing rod fitted in said second through passage of said cartridge to divide said first through passage into two lateral zones respectively corresponding to said recesses of said rotational members, said sliding member being slidably fitted in one of said lateral zones of said first through passage capable of engaging with one of said recesses of said rotational members at said first end, wherein said second end of said sliding element is formed as a curved peripheral surface; and a controlling means including a resiliently pushing assembly and a solenoid for driving said resiliently pushing assembly to move back to a retracted position, said resiliently pushing assembly having an arm extending generally parallel to its moving direction, said arm being capable of engaging with said second end of said sliding element of said latching assembly such that, when said solenoid is de-energized, said resiliently pushing assembly can be normally moved forward to a latching position to have said first end of said sliding element moved out of said first through passage of said cartridge to be engaged with one of said recesses of said rotational members so as to lock a respective handle for protecting the door from being unlocked by the respective handle, when said solenoid is energized, said resiliently pushing assembly can be moved back by said solenoid to the retracted position so that said first end of said sliding element can move into said first through passage of said cartridge so as to free the respective handle to allow the door to be unlocked by the respective handle;

whereby said sliding element can be selectively fitted in one of said lateral zones of said first through passage of said cartridge to allow said sliding member to engage one of said recesses of said rotational members so as to selectively lock a respective handle to protect the door from being unlocked by the respective handle.

2. A structure for electrical locks as claimed in claim 1, wherein said resiliently pushing assembly is moved forward to the latching position by a compression spring disposed around a shaft thereof between said arm and said solenoid.

3. A structure for electrical locks as claimed in claim 2, wherein said resiliently dividing rod is provided with a stopping collar at an outward end thereof and a compression spring around a portion thereof within said second through passage of said cartridge to provide a normally resilient force toward said second through passage.

4. A structure for electrical locks as claimed claim 3, wherein said sliding element can be moved from one lateral zone to the other lateral zone of said first through passage of said cartridge by fitting said resiliently dividing rod into said recess of said sliding element and then pushing said sliding element toward the other lateral zone via using a tool through a hole of said cartridge.

5. A structure for electrical locks as claimed in claim 3, wherein said arm have a front end extends in a curved direction capable of mating with said second end of said sliding member to facilitate a movement of said sliding element along said first through passage of said cartridge.

* * * * *